US008061900B1

(12) United States Patent
Bierschenk

(10) Patent No.: US 8,061,900 B1
(45) Date of Patent: Nov. 22, 2011

(54) SEMI-RIGID FLEXIBLE FILM PACK FOR MULTI-PACKS

(75) Inventor: Patrick Joseph Bierschenk, Dallas, TX (US)

(73) Assignee: Frito-Lay North America, Inc., Plano, TX (US)

( * ) Notice: Subject to any disclaimer, the term of this patent is extended or adjusted under 35 U.S.C. 154(b) by 0 days.

(21) Appl. No.: 13/190,575

(22) Filed: Jul. 26, 2011

Related U.S. Application Data

(62) Division of application No. 11/756,897, filed on Jun. 1, 2007, now Pat. No. 8,006,467.

(51) Int. Cl.
*B65D 30/20* (2006.01)

(52) U.S. Cl. ..... 383/120; 383/104; 206/526

(58) Field of Classification Search ..... 383/104, 383/120, 33, 78, 93, 94, 98; 206/526
See application file for complete search history.

(56) References Cited

U.S. PATENT DOCUMENTS

| | | | | |
|---|---|---|---|---|
| 3,457,707 | A * | 7/1969 | Fesco | 55/376 |
| 5,080,043 | A * | 1/1992 | Fields | 119/168 |
| 6,164,821 | A * | 12/2000 | Randall | 383/34 |
| 6,499,253 | B2 * | 12/2002 | Weder | 47/72 |
| 6,643,995 | B1 * | 11/2003 | Koyama et al. | 53/453 |
| D596,936 | S * | 7/2009 | Bierschenk et al. | D9/432 |
| D599,656 | S * | 9/2009 | Bierschenk et al. | D9/432 |
| 8,006,467 | B2 * | 8/2011 | Bierschenk | 53/452 |
| 2008/0118188 | A1 * | 5/2008 | Jones | 383/33 |

* cited by examiner

*Primary Examiner* — David Fidei
(74) *Attorney, Agent, or Firm* — Colin P. Cahoon; Amanda K. Jenkins; Carstens & Cahoon, LLP

(57) ABSTRACT

A semi-rigid flexible film pack for multi-packs, and method for manufacturing same, constructed from a gusseted bag. The invention provides for modifying a gusseted bag, heat sealing the gussets to their respective side walls, loading said gusseted bag with product, and then sealing the open end of the gusseted bag with a single sheet or web. The method of making this package is economical yet provides for a semi-rigid container ideal for use with single-serve pillow bags.

7 Claims, 3 Drawing Sheets

SEMI-RIGID FLEXIBLE FILM PACK FOR MULTI-PACKS

CROSS REFERENCE TO RELATED APPLICATION

This application is a divisional of U.S. application Ser. No. 11/756,897 entitled "Method for Making a Semi-Rigid Flexible Film Pack for Multi-Packs" and filed on Jun. 1, 2007.

BACKGROUND OF THE INVENTION

1. Technical Field

The present invention relates to a semi-rigid flexible film pack that can be used for containing multiple packages of a product and a method for making same. The invention uses standard flexible film pre-made gusseted bags as a starting material. In a preferred embodiment, the gussets on the gusseted bag are heat-sealed to the side walls, product (typically pillow bags containing a snack food) is placed within the gusseted bag, and the open end of the gusseted bag is sealed by application of a single sheet or web of film.

2. Description of Related Art

The snack food industry typically markets snack foods in flexible film packages referred to as pillow bags due to their shape that is similar to a pillow. These pillow bags are typically made on vertical form, fill, and seal packaging machines. The pillow bags come in a variety of shapes and sizes, anywhere from small single-serve bags of about 6 inches in height and 5 inches in width, to much larger packages in excess of 20 inches in height and 12 inches in width.

With the smaller single-serve type pillow bags, it is frequently preferable to market and sell several of these pillow bags as a combined unit. In the prior art, this has typically been accomplished by placing the pillow bags in a rectangular shaped cardboard container having an open top and then sealing the container with a flexible film that encloses the entire cardboard box, including its opening. The advantage of such cardboard box is that the cardboard provides a semi-rigid structure that is somewhat protective of the pillow bags. This prior art solution, however, has several drawbacks. For example, the use of the cardboard box adds to both the expense of producing the combined packaging and to the shipping weight of the combination. Further, several steps are involved in forming the box, filling the box, and enclosing the box with a flexible film. Also, the cardboard material used to construct the box is not transparent. Consequently, the consumer can only observe the contents of the box through the top or sealed end.

Another prior art solution is to fill a larger pillow bag with smaller pillow bags. A related solution is to have a flexible film sack that is filled with pillow bags and simply tied at the top. Both of these prior art solutions are less expensive and easier to manufacture than the cardboard box solution described above. However, they do not provide for structural integrity of the overall container, as is accomplished with the cardboard box arrangement. The shape of the stuffed large bag is also not conducive to stacking.

Consequently, a need exists for a semi-rigid container that is relatively simple and inexpensive to manufacture, yet also provides some structural rigidity to the overall package. Such container should ideally be roughly rectangular shaped to facilitate stacking and transparent absent graphics placed on the container.

SUMMARY OF THE INVENTION

The proposed invention uses prior art gusseted bags that are modified and then formed into a semi-rigid package for containing multiple pillow bags or similar articles. The gusseted bag, which is basically a five-sided container having an open end, one bottom (or closed end) wall, four side walls, and two gussets located at two opposed side walls, are common in the prior art. Such prior art gusseted bags are used, for example, in the bread packaging industry for containing loaves of bread. However, Applicant's invention contemplates using a gusseted bag with much shorter side walls, such that when it is placed on a rectangular mandrel it assumes more of a shoe-box shape.

First, the prior art gusseted bag is slit in corners at the open end of said gusseted bag, or stated differently, at the intersection of each side wall starting at the open end of the gusseted bag to a defined distance towards the closed end wall. The slits then define four flaps or flanges located at the open end of the gusseted bag. The gusseted bag can also be perforated along one or more sides, either on a side wall or at the closed end. In a preferred embodiment, the gusseted bag is placed over a rectangular shaped male mandrel. Once on the mandrel, the gussets (located on two of the side walls) are, in one embodiment, heat sealed to their respective side walls. Heat sealing the gussets in such fashion, which is optional, provides for increased rigidity of the side wall and helps maintain the rectangular shape of the package that is being formed.

Next, the gusseted bag is removed from the male mandrel and inserted into a rectangular shaped female mandrel. The female mandrel pulls the aforementioned flanges away from the open end of the gusseted bag and holds them in a position that is perpendicular to the side walls with which they are contiguous. Next, product, such as several pillow bags, is placed into the gusseted bag. The opening of the gusseted bag is then sealed by placing a single sheet or web of film over the opening and heat sealing this web to the flanges.

The resultant semi-rigid container is relatively simple and inexpensive to manufacture, yet also provides structural rigidity to the overall package. Applicant's container is rectangular shaped to facilitate stacking and is totally transparent, absent graphics placed on the container.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION OF THE PREFERRED EMBODIMENTS

The starting point for Applicants invention is a prior art container referred to in the industry as a "gusseted bag." A gusset is a pleat made into the bag. When a gusset is put into a bag then the bottom of the bag is squared, thus eliminating what is commonly referred to as "dog ears," or the corners of the bag that would otherwise stick out. Examples of gusseted plastic bags include prior art containers for bread loaves. These containers have gussets proximate to two opposed side walls adjacent to the bottom (or closed end) of the bag. It is this type of gusseted bag, having gussets on opposed sides near the bottom of the bag that Applicant is referring to when referencing a "gusseted bag." Such gusseted bags are available in many different sizes and shapes from, for example, Multi-Pak USA, Inc. of Dacula, Ga.

Figure 1:
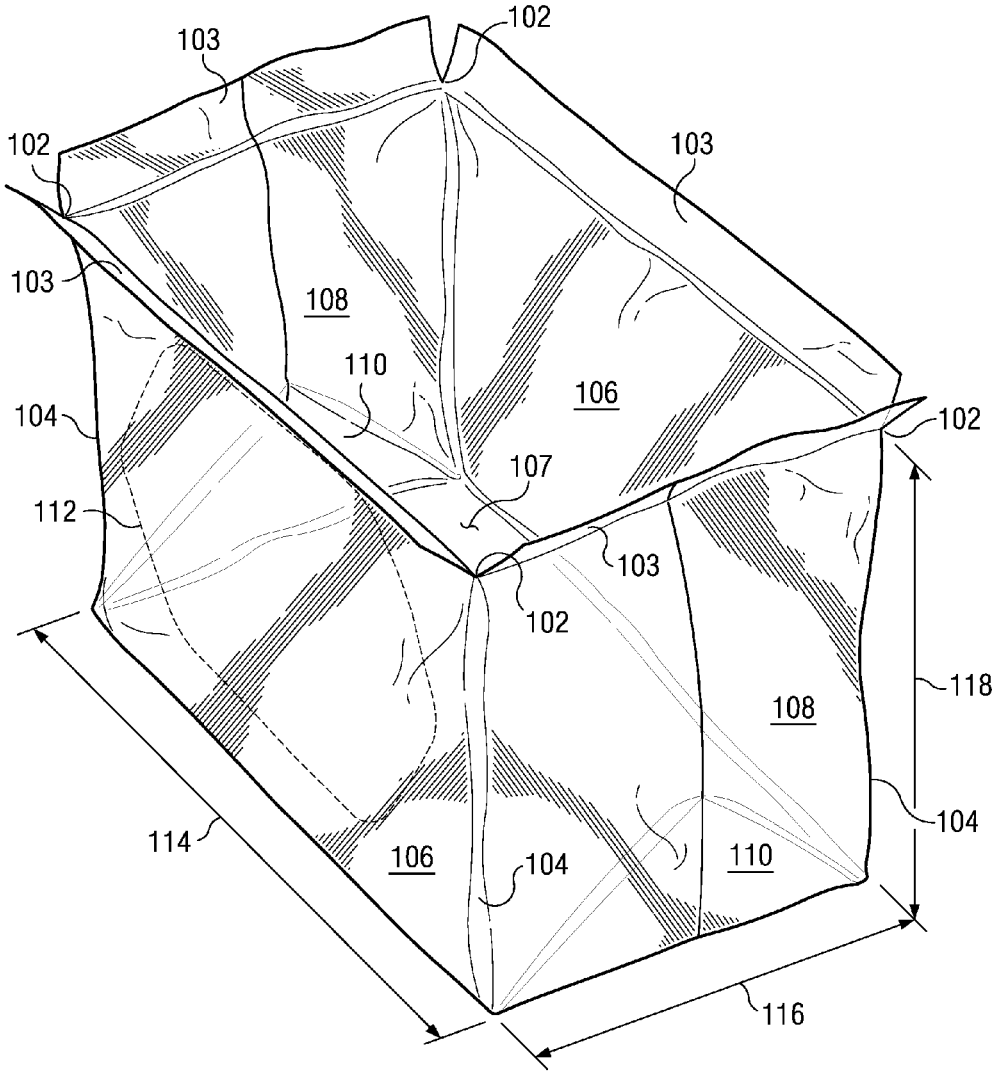
FIG. 1 is a perspective view of a prior art gusseted bag with modifications in accordance with Applicant's invention.

FIG. 1 shows a prior art gusseted bag that has been modified in accordance with Applicant's invention. Specifically, FIG. 1 shows that slits 102 have been cut into the corners of the gusseted bag at its open end. Stated another way, a slit 102 is cut at the intersection 104 of each side wall 106, 108, of the gusseted bag, with the slit 102 starting at the open end of the gusseted bag to a defined distance towards the closed end 107. (While the term "intersection 104 of each side wall 106, 108" is used, it is understood that this "intersection" is in fact a crease in the film, as all the side walls 106, 108 are integral to each other.) Such defined distance, or length of the slit, in a preferred embodiment is about 0.25 to about 1.0 inches, or most preferably about 0.75 inches. Once these slits 102 are made, they define four flaps or flanges 103 located at the open end of the gusseted bag.

It should be noted that the general dimensions of the gusseted bag shown in FIG. 1 are rectangular with short side walls 106, 108, giving the end product, as will be discussed later, more of a shoe box sized configuration. This necessitates two wide side walls 106 and two narrow side walls 108. In a preferred embodiment, the gussets 110 are associated with or proximate to respective narrower side walls 108. However, Applicants invention contemplates that the gussets 110 could be associated with or proximate to any two opposing side walls 106, 108.

When the gusseted bag is squared up, the preferred ratio of the width 114 of the wide side wall 106 (also referred to by Applicant as the length of the container) to the width 116 of the narrow side wall 108 (also referred to by Applicant as the width of the container) is in the range of 1.6 to 1.9. A typical range of sizes for a preferred embodiment container pursuant to Applicants invention requires a starting gusseted bag when squared up of from about 8 inches long 114 by 4.25 inches wide 116 by 5.5 inches tall 118 (measured from the bottom of the slit 102), to about 11 inches long 114, to 6 inches wide 116, to 6 inches tall 118. The above-stated dimensions result in a finished container of the same size.

Also shown as a modification to a prior art gusseted bag in FIG. 1 is a perforation 112 along one side wall 106. This perforation 112, placed in the side wall 106 by means known in the art, allows for access to the inside of the formed container by tearing at the perforations and removing the piece defined by such perforations 112. This provides access to the interior of the formed container.

In a preferred embodiment the gusseted bag used as a starting point for Applicant's invention is constructed of a flexible film material, such as a single layer of polyethylene. Alternative materials that can be used include, but are not limited to, single layer polypropylene or a multilayer structure of polypropylene and polyethylene. The polyethylene is preferred because of its general durability, transparency, heat sealing characteristics, tear resistance and because it is generally inexpensive. The sheet thickness for a polyethylene gusset bag in accordance with Applicant's invention, is preferably between 2 mil and 3 mil.

Although the gusseted bag illustrated in FIG. 1 is shown in an open configuration, giving it a boxy shape, one advantage of a gusseted bag is that it can lie flat, also in a rectangular shape. This feature of a gusseted bag makes shipping and storage of the gusseted bags prior to use with Applicant's invention easy and economical.

Figure 2:
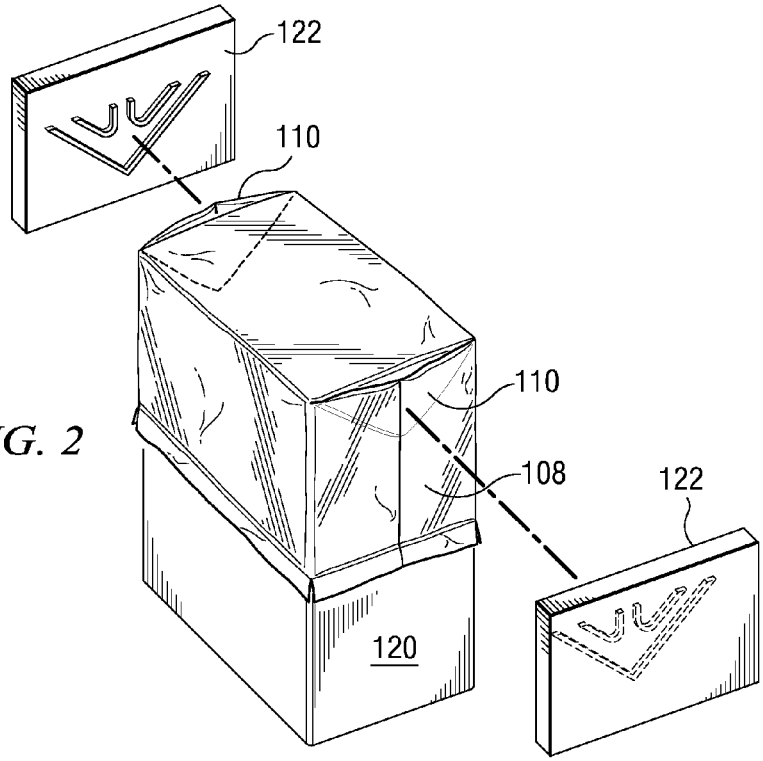
FIG. 2 is a perspective view in elevation of a gusseted bag mated with a rectangular male mandrel.

Once the slits 102 have been cut in the gusseted bag, and optionally the perforation 112 made in one or more side walls 106, 108, or the closed end wall 107, the gusseted bag is mated with or placed over a male mandrel. This is illustrated in FIG. 2. Unless otherwise noted, identical elements are identified by identical number designations throughout this Specification.

In FIG. 2, the modified gusseted bag is shown being placed over a male mandrel 120. This male mandrel 120 shapes the gusseted bag into its rectangular form and holds it in such shape allowing for two heating elements 122 to be physically pressed against the area on the gusseted bag where each of the gussets 110 are located. The film that makes up a narrow side wall 108 and its respective gusset 110 is pressed between the surface of the inserted male mandrel 120 and the heating element 122 for a sufficient amount of time for the gusset 110 to heat seal against its respective side wall 108. The heating element seals by conductive heat, impulse seal, or other similar techniques. In a preferred embodiment example wherein the film used on the gusseted bag is a single layer of polyethylene of an approximate thickness of 2.5 mil, heating elements 122 at a temperature of approximately 200 C, are held against the gusseted bag while over the male mandrel 120 for approximately 1 sec in order to adequately seal the gussets 110 to their respective side walls 108. Heat sealing the gusset 110 to the side wall 108 increases the rigidity of the formed container, however is not required. An alternative embodiment of Applicant's invention forms the container described herein without heat sealing the gussets 110 to their respective proximate side walls 108.

Figure 4:
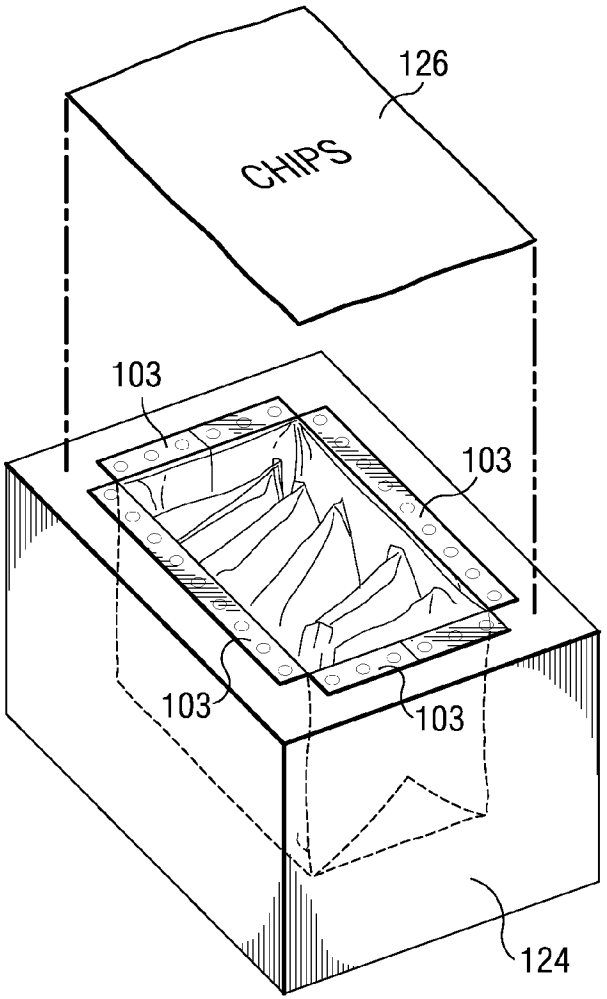
FIG. 4 is a perspective view in elevation of a loaded gusseted bag immediately prior to sealing with the sealing web.
Figure 3:
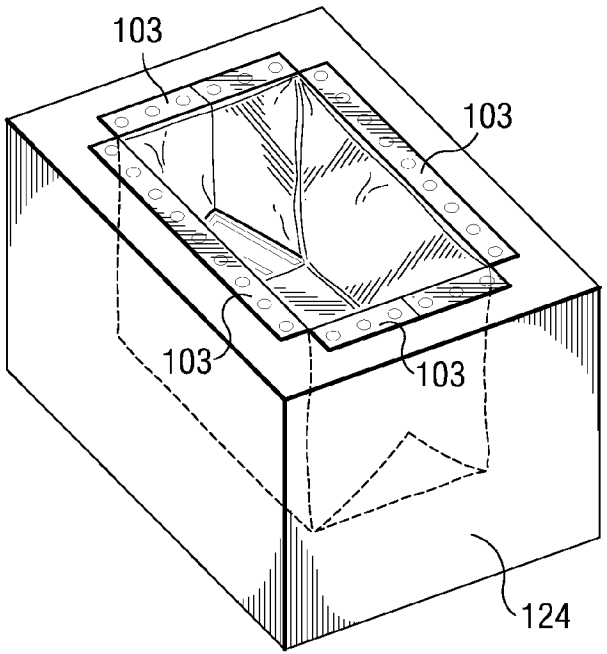
FIG. 3 is a perspective view in elevation of a gusseted bag placed inside a rectangular female mandrel.

Referring now to FIG. 3, after the gussets have been heat sealed to their respective proximate side walls, the modified gusseted bag is next placed inside a female mandrel 124. This female mandrel 124 comprises a means for pulling the flaps or flanges 103 away from the open end of the modified gusseted bag and holding them against the surface of the female mandrel 124, as is depicted in FIG. 3. Such means can include applying a vacuum in the vicinity of the flanges 103, when the gusseted bag is seated within the female mandrel 124. The end result is that the flanges or flaps 103 become oriented perpendicular to their respective side walls, for reasons that will become apparent in reference to FIG. 4.

Once the gusseted bag is oriented as depicted in FIG. 3 with the flanges 103 held down, product, such as a plurality of pillow bags (depicted in dashed lines in FIG. 4), is loaded into the modified gusseted bag. Next, and again in reference to FIG. 4, a sheet or web of film 126 is placed over the open end of the gusseted bag. The outside edges of this sheet or web 126 are lined up with the outside edges of the four flanges 103 and subsequently heat sealed to said flanges 103, thus forming a cover 126 or sixth wall/side for the finished six-sided container. After the web or cover 126 is heat sealed to the flanges 103, the container has been formed and is removed from the female mandrel. It should be noted that the web 126 can optionally be perforated prior to application to the flanges 103. Consequently, it is understood that any one or more of the six sides/walls of the formed container can have perforations that allow access to the interior of said formed container through the respective wall.

Figure 5:
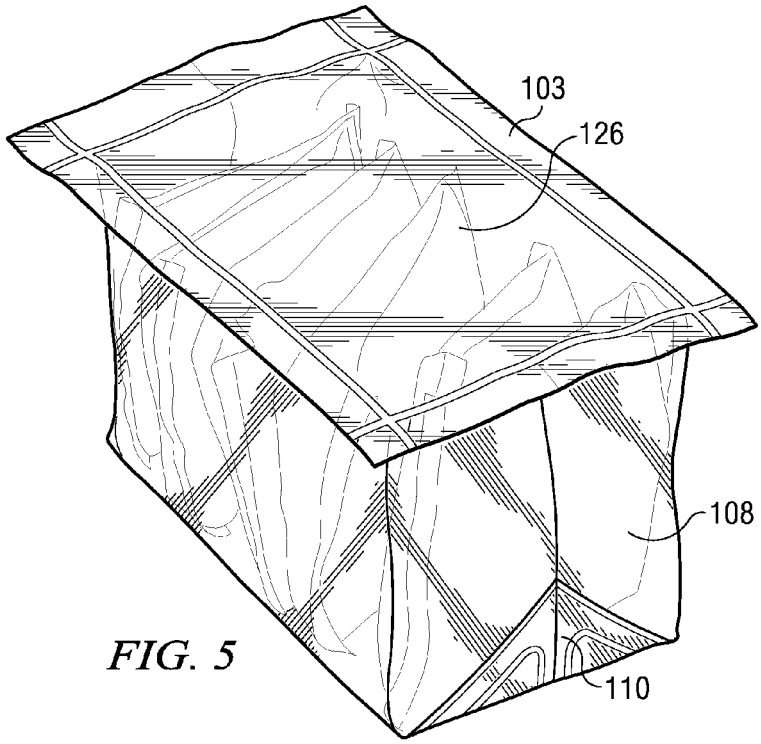
FIG. 5 is a perspective view in elevation of the finished semi-rigid flexible film pack in accordance with Applicant's invention.

The end result of Applicant's method is shown in FIG. 5. It can be seen from FIG. 5 that the web or cover 126 has been sealed over the open end of the modified gusseted bag by mating with the flanges 103. While the cover 126 is shown in FIG. 5 to form the top of the container, it should be understood that the entire formed container can be oriented with the cover 126 as the base or bottom of the container. Consequently, rather than referring to a top or bottom of the formed container, Applicant refers to a "covered end" 126 and its opposed "closed end" on the other side of the container, which would be the bottom of the container in FIG. 5. Also shown in FIG. 5 is the gusset 110 heat sealed to its respective proximate side wall 108. Shown within the formed container, illustrated in dashed lines, is product that is secure within the container. In this instance, the product illustrated is a plurality of pillow bags. These pillow bags in turn, in a preferred embodiment, contain a food, for example, and without limitation, potato chips, corn chips, tortilla chips, extruded products, baked dough products, nuts, candy, fruit pieces, dried meats, and other foods.

Although it can also be varying grades of opaque, the preferred embodiment of Applicant's container is formed with a flexible film that is transparent. As a consequence, the consumer is able to observe the product contained within the container. Graphics labels can be subsequently applied to any of the six sides of the container or, alternatively, graphics can be pre-printed on the gusseted bag itself and/or the cover/web 126 such that the formed container presents graphics on one or more of the six sides. As previously noted, and in reference to FIG. 1, perforations 112 can be made on any of the six sides allowing easy access to the interior of the container. Once formed, this container is a semi-rigid, yet flexible container suitable for presenting several smaller containers (for example the pillow bags) as one single unit.

Pillow bags are common in the prior art and are typically made by vertical form, fill and seal machines using a single web of film wrapped around a forming tube. The web of film then receives a back seal to form the web into a tube. An end seal is placed at the bottom of the tube, and product is then dropped through the tube into the pouch formed by the end seal. Another end seal is then formed above the level of the product, and the tube is cut at this upper end seal, thus forming the familiar pillow bag. These pillow bags are frequently used for containing snack foods such as potato chips, corn chips, pretzels, cookies, and other foods.

Such pillow bags have a higher rigidity at the end seals than along the rest of the body of the bag by virtue of the fact that the end seals are at least double (and in some locations, triple or quadruple) the thickness of the walls of the bag. Consequently, in a preferred embodiment of Applicant's invention, when pillow bags are placed within the modified gusseted bag, they are oriented such that the end seals of the pillow bags are parallel to the side walls of the modified gusseted bag. Stated differently, when loaded in this preferred embodiment, the container holds a plurality of pillow bags all oriented with their end seals running perpendicular to the top and bottom of the container when displayed for sale. As a consequence, these end seals from the pillow bags provide additional rigidity and vertical support for the formed container.

While the invention has been particularly shown and described with reference to a preferred embodiment, it should be understood by those skilled in the art that various changes in form and detail may be made therein without departing from the spirit and scope of the invention.

What is claimed is:

1. A container having six walls, said container comprising;

a gusseted bag consisting of a flexible film, said gusseted bag further comprising six walls consisting of a covered end wall and four integral side walls integral with and perpendicular to one closed end wall, wherein said closed end wall is opposite said covered end wall, wherein further said side walls are slit at their respective intersections, thus forming four flaps at the covered end of the gusseted bag, wherein further two opposed side walls each comprise a gusset heat sealed to its respective side wall;

a product contained within the walls of the gusseted bag; and a cover heat sealed onto said flaps, thus forming said covered end wall.

2. The container of claim 1 further comprising perforation on at least one of the six walls.

3. The container of claim 1 wherein said product consists of a plurality of pillow bags.

4. The container of claim 3 wherein said plurality of pillow bags are oriented within said flexible film container such that the end seals on said pillow bags are parallel to the side walls of the flexible film container.

5. The container of claim 1 wherein said flexible film container further comprises graphics.

6. The container of claim 1 wherein said container comprises polyethylene.

7. The flexible film container of claim 1 wherein said container consists of rectangular dimensions of between about 8 inches long, 4.25 inches wide, and 5.5 inches tall and about 11 inches long, 6 inches wide, and 6 inches tall.

* * * * *